United States Patent [19]

Ares et al.

[11] Patent Number: 4,502,292

[45] Date of Patent: Mar. 5, 1985

[54] CLIMATIC CONTROL SYSTEM

[75] Inventors: Roland A. Ares; Mark W. Sylvester, both of St. Charles, Mo.

[73] Assignee: Hussmann Corporation, Bridgeton, Mo.

[21] Appl. No.: 438,922

[22] Filed: Nov. 3, 1982

[51] Int. Cl.[3] ..... F25B 27/02

[52] U.S. Cl. ..... 62/238.6; 237/2 B

[58] Field of Search ..... 62/160, 238.6, 238.7, 62/324.4, 324.1, 324.5, 324.7; 237/2 B; 165/29

[56] References Cited

U.S. PATENT DOCUMENTS

| | | | |
|---|---|---|---|
| 2,474,304 | 6/1949 | Clancy | 62/160 UX |
| 2,919,558 | 1/1960 | Laver | 62/160 |
| 3,026,687 | 3/1962 | Robson | 62/160 |
| 3,132,492 | 5/1964 | McGrath | 62/324 |
| 4,173,865 | 11/1979 | Sawyer | 62/324 |

*Primary Examiner*—William E. Wayner

*Attorney, Agent, or Firm*—Richard G. Heywood

[57] ABSTRACT

A climatic control system for the seasonal heating and cooling of air circulated through a temperature control chamber, including a three coil heat pump having a cooling mode coil and a separate heating mode coil positioned in the chamber for selective operation, and a heat reclaim condenser coil of a separate refrigeration system positioned between the cooling and heating mode coils for selective operation therewith.

18 Claims, 3 Drawing Figures

CLIMATIC CONTROL SYSTEM

BACKGROUND OF THE INVENTION

The invention relates generally to the art of climatic control systems, and more particularly to improvements in reverse cycle heat pumps for both heating and cooling recirculated room air.

The present invention is particularly beneficial in commercial and industrial installations, such as food markets, convenience stores, restaurants, warehouses and manufacturing or processing facilities and the like having primary refrigeration systems to provide multiple refrigeration needs as for cooling low and normal temperature display and storage fixtures, or product cases or zones. The air within such a market or warehouse facility is generally circulated and heated or cooled to maintain a comfortable environment, and this recirculation and temperature (and humidity) conditioning of air is conventionally handled by apparatus completely separate from and independent of the primary commercial or industrial refrigeration system.

In the past, numerous climatic control systems have been designed to provide selective cooling (air conditioning) and heating of recirculated air, and in recent years it has become a prevalent practice to incorporate an auxiliary refrigeration system condenser or heat reclaim coil that is physically located in an air heating duct and selectively connected to the main refrigeration system compressors in order to reclaim and use some of the heat of condensation as an air heating medium thus meeting some of the environmental heating requirements of the store. It is recognized that such reclaimed heat would normally be lost to the ambient in an outside condenser of a conventional commercial refrigeration system, and thus some valuable energy and cost savings are realized by reclamation of this heat for store heating purposes. It is also recognized generally that such reclaimed heat is totally inadequate for major heating days during the winter and some form of supplemental heating is required, and various systems have been used including reverse cycle heat pumps. Such heat pumps normally provide an air conditioning coil in the air ductwork for conventional summer air conditioning, and provide a reverse refrigerant flow path during winter heating so that the same coil will function as a condenser in the same manner as the reheat coil just discussed. However, the arrangements of various components in past climatic control systems have not been energy efficient or utilized the aggregate heating potential of the heat pump and refrigeration system heat reclaim coil.

SUMMARY OF THE INVENTION

The invention is embodied in a climatic control system for the seasonal cooling and heating of air circulated through a temperature control airway, including a three coil heat pump having a first coil exposed to ambient and separate cooling mode and heating mode coils sequentially positioned in the airway for selective operation, and a heat reclaim condenser coil of a separate refrigeration system being positioned in the airway between said cooling and heating mode coils for selective operation therewith.

The principal object of the present invention is to provide a novel climatic control system for selectively heating and cooling air circulated in a closed environment, space or room.

Another object is to provide a novel reverse cycle heat pump for cooling and heating operations alone or in combination with heat reclaiming means of a separate refrigeration system.

Another object is to provide a system that is energy efficient and has a greatly increased heating potential by utilizing both a reverse cycle heat pump and a refrigeration system heat reclaim coil working together.

These are still other objects and advantages will become more apparent hereinafter.

DESCRIPTION OF THE DRAWINGS

For illustration and disclosure purposes the invention is embodied in the parts and in the combinations and arrangements of parts hereinafter described. In the accompanying drawings forming part of the specification and wherein like numerals refer to like parts wherever they occur.

BRIEF DESCRIPTION OF THE PREFERRED EMBODIMENTS

Figure 1:
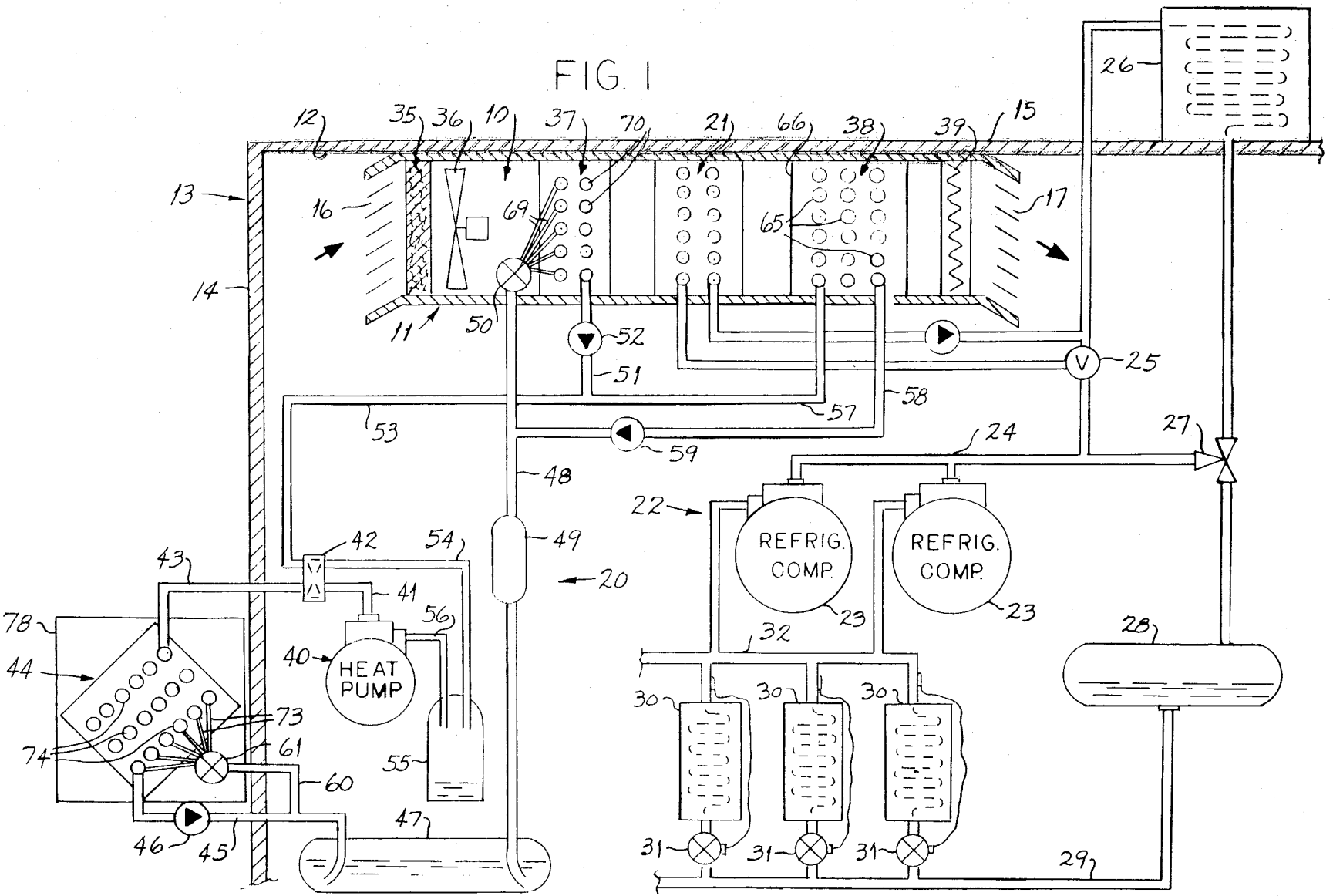
FIG. 1 is a diagrammatic illustration of a climatic control system embodying the present invention as incorporated in a building having a commercial refrigeration system.

The climatic control system embodying the invention provides the efficient cooling and heating of room air to be circulated in a building, and thus accommodates year-round air temperature conditioning as needed for comfort. As used herein, the word "conditioning" may be used in the broad context of air temperature regulation, and is not restricted to mean merely air refrigeration or cooling. For disclosure purposes, as shown in FIG. 1, the climatic control system has its temperature conditioning components mounted in the conditioning chamber 10 of a ducted airway 11 mounted on or near the ceiling 12 or other suitable location in a building 13, which is shown with a side wall 14 and roof 15. The ducted airway 11 is frequently referred to in the art as an air handler unit and conventionally includes an air intake end or inlet opening 16 and air discharge end or outlet opening 17, which may be louvered. Such air handler units provide for bringing room air into the conditioning chamber 10 and moving it through the sequential components for cooling or heating, and discharging the treated air back into the room or space for controlling its environmental temperature. The air moving means may be located at either end of the conditioning airway to push through or to draw through. It should be noted that such air handler units 11 may also have provisions for bringing in fresh ambient air from outside the building 13, but the present invention pertains to improvements in the cooling and heating cycles or modes of conditioning and not the details of the air handling package per se.

Still referring primarily to FIG. 1, the climatic control system comprises a reverse cycle heat pump system 20, which may be used in combination with the heat reclaim condenser coil 21 of a conventional commercial refrigeration system 22 or the like. Such a refrigeration system 22 typically may be of the type which may be installed in a supermarket, convenience store or the like for refrigerating a number of different display or storage fixtures, lockers, cutting rooms, etc. The primary refrigeration system 22 may have a single compressor low temperature system and/or a single compressor normal temperature system. However, as shown in FIG. 1, a typical low or normal temperature system may have dual or twin compressors 23 connected in parallel through a high side discharge header 24 from which hot compressed refrigerant vapor is discharged to a three-way control valve 25 for selective operation to connect to an outdoor or rooftop condenser 26 or to the heat reclaim condenser coil 21 when heat conditioning in the airway 11 is required. The heat reclaim coil 21 is then connected in series to the outside condenser 26, which still performs the final and principal function of condensing the refrigerant to a liquid. In other words, although the heat reclaim coil 21 will reclaim the superheat of compression and some latent heat from the refrigerant vapor, it is important that the condensing temperature of the refrigerant be reached in the outdoor condenser 26 to obviate refrigerant liquid in the heat reclaim coil 21. U.S. Pat. No. 3,358,469 discloses a more detailed discussion of heat reclaim condenser coils and their operation. However, it should again be noted that the use of heat reclaiming coils in the past has been as a supplemental heat to a primary, conventional heat source, and has not been successfully incorporated in a climate control system utilizing a reverse cycle heat pump.

The remainder of the refrigeration system 22 includes a back pressure modulating valve 27 for condenser flooding to maintain compressor head pressures during winter operations, a receiver 28 forming a source of liquid refrigerant, liquid line 29, a plurality of evaporator coils 30 for fixtures, cases, coolers, lockers or the like with thermostatic expansion valves 31 and which return the heated vaporized refrigerant to a suction header 32 back to the low suction side of the compressors 23.

The ducted airway 11 of the climatic control system incorporates the following sequentially arranged components from the air intake 16 to the air discharge end 17; an air filter 35, a push-through fan or like air moving means 36 (although a draw-through fan or blower may be located at the discharge end 17), the air conditioning (cooling) coil 37 of the reverse cycle heat pump system 20, the heat reclaim condenser coil 21 of the refrigeration system 22, a separate heating coil 38 of the heat pump system 20 (sometimes referred to herein as the "third" coil), and an auxiliary heating element, such as electric heater 39. The efficiency of the reverse cycle heat pump system 20 virtually eliminates the need for the auxiliary heater 39 except on severe winter days.

Figure 2:
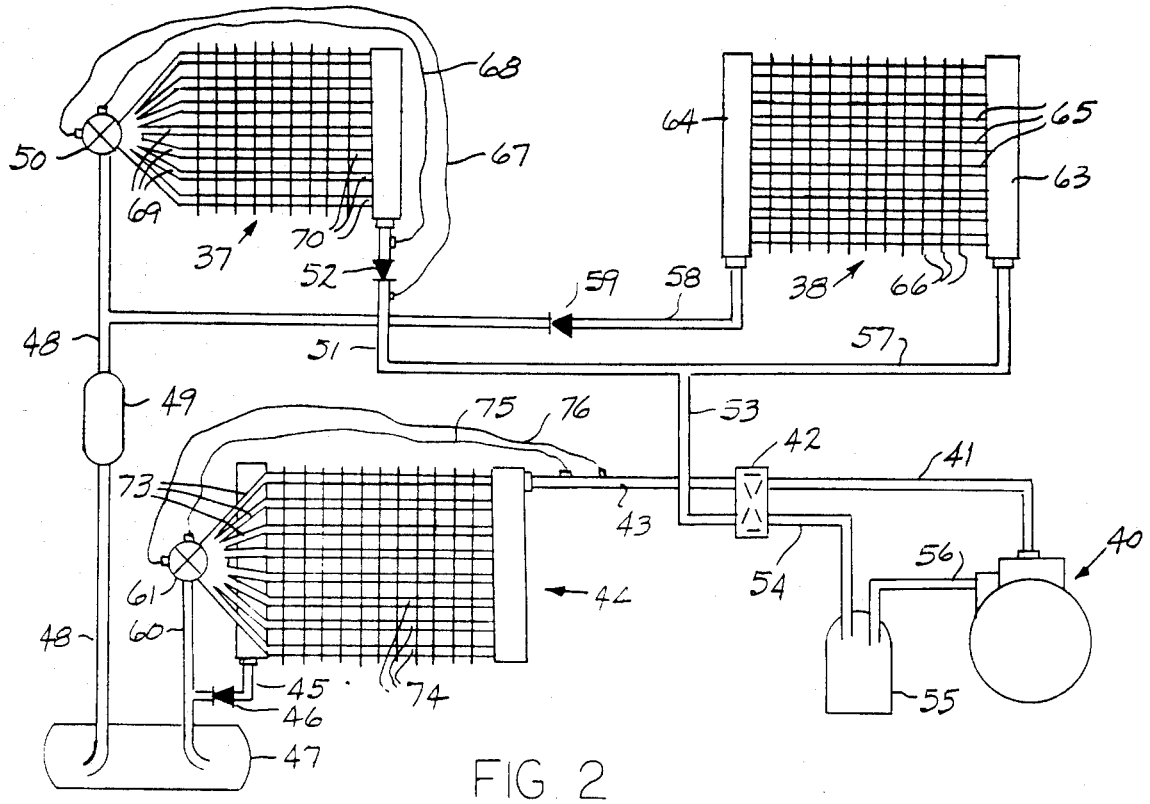
FIG. 2 is a diagrammatic illustration of one embodiment of a three coil heat pump system having part of the present invention.

Referring to FIGS. 1 and 2, the reverse cycle heat pump system 20 comprises a compressor 40 having its high side discharge line 41 connected to a four-way reversing valve 42. In the cooling mode of the climatic control system when summer air refrigeration is needed, the reversing valve 42 connects by conduit 43 to an outdoor condenser 44 having an outlet line 45 with one-way check valve 46 connected to a double pickup receiver 47. The other pickup conduit 48 (liquid line for air cooling) is connected through a two-way filter-dryer 49 to the expansion valve 50 of the air cooling evaporator 37. The outlet line 51 from the air cooling coil 37 has a one-way check valve 52 and is connected to a conduit 53, which connects to the four-way reversing valve 42. The suction side of the reversing valve 42 has a conduit 54 leading to a suction accumulator 55, which also receives the suction line 56 to the low side of the compressor 40. Operation of the air cooling cycle or mode is conventional, although it should be noted that the air cooling coil 37 is upstream in the air flow path through the airway 11 of the respective heating components 21, 38 and 39, which are inoperative during the cooling mode except for the selective operation of the heat reclaim coil 21 to dehumidify the refrigerated air discharged through the cooling evaporator 37.

In the preferred embodiment of FIGS. 1 and 2, the reverse cycle heat pump system 20 does not use the cooling coil 37 in the heating mode of air temperature conditioning. In the reverse heating cycle, the four-way valve 42 is reversed to connect the compressor discharge conduit 41 to the conduit 53, and connect the outside condenser 44 to the suction side (54–56) of the compressor 40. The conduit 53 thus becomes the high side discharge conduit and connects to inlet conduit 57 leading to the heating coil 38, by-passing the line 51 due to check valve 52. The third or heating coil 38 thus becomes the system condenser and reduces the high side heat pump vapor to its saturated condensing temperature and discharges through outlet conduit 58 and check valve 59 into the conduit 48 for flow into the receiver 47. The outdoor condenser 44 has a liquid feeder line 60 in by-pass relation to the check valve 46, and expansion valve 61 feeds refrigerant into the outside coil 44 to pick up heat from the ambient and refrigerant vapor is returned through conduit 43, reversing valve 42, suction line and accumulator 54,55 to the compressor suction side. The heating or third coil 38 of the heat pump system 20 is shown with a high side gas intake or receiving header 63 having a bottom (or side) connection to the conduit 57, and a liquid discharge or outlet chamber 64 with a bottom outlet connection to discharge conduit 58. Multiple coil passes or tubing 65 extend between these headers 63,64 and may be pitched or angled downwardly toward the discharge header 64 to facilitate drainage of refrigerant condensate, and this third coil 38 also includes the usual heat exchange fins 66 extending parallel to the direction of air flow through the coil.

It has been noted that in the reverse heating mode, the compressor high side 41,53 is blocked from the cooling coil 37 of the system by check valve 52 in line 51, and the cooling coil 37 is also blocked from the line 48 by the expansion valve 50 which has a pilot control connected by an external equalizer line 67 to sense the pressure in the conduit 51 on the outlet side of check valve 52. The internal pilot control of the expansion valve 50 responds to a preset mean operating pressure differential (MOPD) between the expansion valve inlet side (48) and the pressure sensing point so that the expansion valve is tightly closed when a pressure greater than the MOPD is sensed through the equalizer line 67. (In the refrigerating or air cooling cycle of the heat pump 20, the expansion valve 50 operates in a normal manner since the conduit 48 is on the high side of the system and the line 51 is connected to the suction side, and refrigerant is metered to the evaporator coil 37 in response to demand through a typical thermostatic control line 68. It will be noted that the expansion valve 50 has multiple feeder lines 69 extending to each of the coil passes or tubes 70 thereby greatly improving the refrigerant distribution and cooling efficiency of this evaporator coil 37 during the cooling mode.)

The outside condenser 44 performs the function of the cooling coil 37 during the reverse cycle heating mode of operation and its expansion valve 61 also has multiple feeder lines 73 tapped into the respective coil tubing passes 74 to provide more efficient heat exchange and optimum vaporization of refrigerant to minimize the volume of refrigerant liquid that may be returned to the accumulator 55 depending upon the outside or ambient temperatures during the heating mode operation of the heat pump system 20. (The expansion valve 61, in addition to its temperature sensing bulb connection 75 for heating mode operation, includes an MOPD equalizer line 76 to close the valve 61 down during summer cooling mode operation so that refrigerant condensate will be discharged from the outside condenser 44 through check valve 46 to the receiver 47 in by-pass relation to the expansion valve.)

Referring again to FIG. 1, the outside condenser 44 may be angularly disposed in its weather housing 78 to provide a gravity assist for more efficient cyclical defrost. It is apparent that during the winter when the heat pump system 20 is in its heating mode, the icing of the outside heat pump coil 44 will be quite rapid and this ice is melted by period reverse cycling the system 20 so that the outdoor coil 44 again functions as a condenser and receives the total heat from compressor 40 to defrost the coil 44 by melting such ice. The coil angularity, such as 45°, greatly facilitates this defrost cycle since the melting of the ice surface along the coils 74 (and fins) allows the ice layer to slide or drop off. Reverse cycling of the system for defrosting of the outside condenser 44 may be required every 90 minutes or so during the winter heating season, and short defrosts are important since in this phase the cooling coil 37 will also again be refrigerating the air flow through the air duct 11 thereby producing cold air although warm air is actually needed. In the past, this has created a major problem in inefficiency and high cost heating operations since the supplemental electric heater 39 would have to be operational to do the major air heating job.

According to the present invention, optimum winter heating results are achieved without requiring expensive, supplemental electric (or gas) heating except on the most severe winter days. The size and orientation of the respective components in the air handler unit 11 is an important factor. The size of the cooling coil 37 is physically limited in relation to the compressor and condenser capacity to provide a balanced refrigeration system and efficient cooling mode of operation. Therefore, on reverse cycle in the heating mode, conventional air conditioning heat pumps are usually inefficient as a heating source due to the small size of the evaporator coil (37)—in other words, although good air temperatures may be produced in conventional heat pumps, the total heat recovery is restricted because of the smaller condensing surface of the coil. The combination of such a conventional heat pump with a heat reclaim coil (21) of a primary refrigeration system would also be counterproductive since in the reverse cycle heating mode the evaporator coil will produce a higher discharge air temperature than the downstream heat reclaim coil so that some of the heat will be transferred or implied into the refrigeration cycle by increasing the surface temperature of the heat reclaim coil above its operating saturated temperature. In the present invention, the third heat coil 38 is located downstream of the heat reclaim coil 21 to provide a sequential heating progression for greatest efficiency and economy of performance. The heat reclaim coil 21 of the primary system 22 is sized to extract a maximum of 75% of the refrigerating effect to avoid liquid condensation in this coil and may raise the temperature of the air flow therethrough by approximately 10°. However, the third heat coil 38 of the present system 20 is substantially larger than either the heat reclaim coil 21 or the evaporator coil 37 (about 60% larger than the latter), so the heating efficiency level achieved by the third coil 38 as a full condenser is also substantially greater than would be obtained by the evaporator 37 if reused alone in a standard reverse cycle heat mode. Thus, the heating coil 38 produces air heating temperatures in the range of 20°, additive to the heat reclaim coil temperatures when needed. It will be understood that on nominal heating days the heat reclaim coil 21 may be sufficient alone to maintain proper comfort zone climatic air control temperatures, and that on colder days the reverse cycle heating mode of the heat pump system 20 produces substantial and efficient higher air heating levels. The requirement for periodic defrosting of the outdoor coil 44 is also met efficiently, since the heat reclaim coil 21 is adequate to temper the cold air flow from the evaporator coil 37 during these short (10 minute) reverse cycle defrosts and the need for the electric heater 39 can be virtually eliminated.

Figure 3:
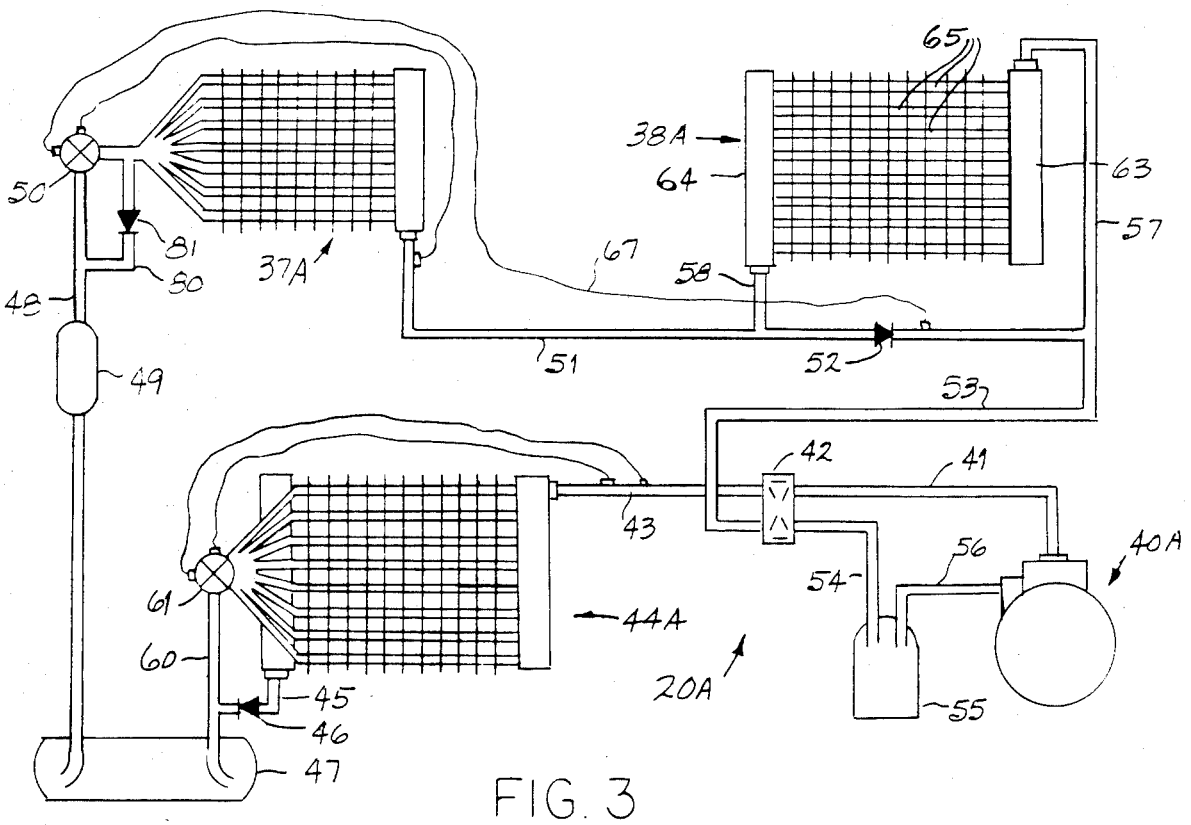
FIG. 3 is a diagrammatic illustration of another embodiment of a three coil heat pump system forming part of the present invention.

Referring now to FIG. 3 wherein another embodiment of the heat pump system 20A is illustrated, the same basic system components are utilized as in the FIG. 2 embodiment and the physical sequential arrangement of components in the air handler unit 11 are the same. However, the third heat coil 38A is piped into the system 20A differently so as to use the cooling coil 37A in series with it during the reverse cycle heating mode. In this embodiment the heat coil inlet conduit 57 is connected to the top of the inlet header 63 and is still connected to the conduit 53, which functions as a suction or return line in the cooling mode and as the high side discharge line in the heating mode of system operation, and the cooling coil discharge line 51 also connects to lines 53 and 37 downstream of the check valve 52. The discharge line 58 from the heat coil 38A is connected to the line 51 upstream of the check valve 52 so that in the heating mode refirgerant will flow from the heat coil 38A through the lines 58 and 51 and through the coil 37A where some additional heat extraction can be obtained. The thermostatic expansion valve 50 of the coil 37A has its external equalizer line 67 connected on the outlet side of check valve 52 and is closed during the heating mode, and the coil 37A is provided with a bypass line 80 and check valve 81 around the expansion valve 50 to return the condensate to the receiver 47 and thence through the expansion valve 61 to the outside condenser 44A and to the suction side of the system 20A. Although the heat recovery in the coil 37A is small due to the high efficiency of the full condensing sized third coil, the aggregate heat recovery is improved by a few degrees and may eliminate the need for the supplemental electric heater 39 in some installations or further minimize its operational needs to effect additional energy and cost savings. It will be noted that the third heating coil 38A is vertically oriented similarly to the heat coil of the FIG. 2 embodiment, and the condenser tubing or passes 65 are preferably sloped for self-draining of the coil to the outlet header 64. If a conventional serpentine-type condenser coil is used as a heating coil 38,38A, the coil should also be vertically oriented in the system and fed at the top for self-draining.

It will be readily apparent that the climatic control system of the present invention provides greatly improved heat recovery and efficiency with minimal disruption or cooling effect during reverse cycle defrosting as required during winter heating days. The construction and operation of this system herein has been chosen for disclosure purposes, and the invention encompasses such changes and modifications as will be readily apparent to those skilled in the art and is only limited by the scope of the claims. For instance, it will be understood by those skilled in the refrigeration art that the refrigeration systems 20 and 22 are diagrammatically illustrated in the drawings and are not intended to show or limit the invention to the piping arrangement to the coils in the airway 11. Those skilled in the art will understand that best heat exchange and optimum efficiency will be obtained by reversing the connections of conduits 57 and 58 to the coil 38 and make similar piping changes for coils 21 and 37 so that the refrigerant feed through each of these coils will be counterflow to the direction of air flow passing through these coils in the airway 11.

What is claimed is:

1. A climatic control system for the seasonal heating and cooling of air circulated through a temperature control airway, comprising a three coil, reverse cycle heat pump having a first coil exposed to ambient, a cooling mode coil and a separate heating mode coil spaced apart and being sequentially positioned in the direction of air flow through the airway and adapted for selective seasonal operation, and means for rendering said cooling mode coil non-operational during the reverse cycle heating mode of operation; and separate refrigeration system means including a heat reclaim condenser coil positioned in the airway intermediate of said cooling mode and heating mode coils and being adapted for selective operation therewith, said heating mode coil being larger than said heat reclaim condenser coil and substantially larger than said cooling mode coil.

2. The climatic control system according to claim 1, in which said heat pump includes a compressor having discharge and suction sides connected to four-way reversing valve means, and said first coil comprises a condenser coil in the cooling mode and an evaporator coil in the heating mode.

3. The climatic control system according to claim 2, in which said cooling mode coil is connected between said first coil and said compressor suction side for refrigerating air flow through said airway during the cooling mode of operation.

4. The climatic control system according to claim 2, in which said heating mode coil is connected between said compressor discharge side and said first coil for heating air flow through said airway during the heating mode of operation.

5. The climatic control system according to claim 1, in which said first coil and heating mode coil of said heat pump have substantially the same heat exchange capacity, and both are substantially larger than said cooling mode coil.

6. The climatic control system according to claim 1, in which said heat reclaim condenser coil and heating mode coil are constructed and sequentially arranged in the direction of air flow through said airway to provide progressive heating of air.

7. The climatic control system according to claim 1, in which said first coil comprises a condenser coil in the cooling mode of said heat pump and an evaporator coil in the reverse cycle heating mode of said heat pump, said first coil being angularly disposed in an outdoor weather housing to facilitate periodic defrosting by reverse cycle operation of said heat pump during the periods of heating mode operation.

8. The climatic control system according to claim 1, in which said airway has inlet and outlet ends, and said air cooling mode coil, heat reclaim condenser coil, and air heating mode coil are sequentially disposed between said inlet and outlet ends.

9. The climatic control system according to claim 1, in which said first coil comprises a condenser in the cooling mode of said heat pump and an evaporator in the heating mode of said pump, and including means for reverse cycle defrosting of said first coil during periods of heating mode operation whereby said heating mode coil is inoperative and said cooling mode coil is made operational, and said heat reclaiming coil being operational during said reverse cycle defrosting to heat the cold air discharged from said cooling mode coil.

10. A three coil, reverse cycle heat pump system for use in seasonal heating and cooling of circulated room air, comprising a heat pump compressor having discharge and suction sides, a first system coil located in an ambient environment, a second system coil positioned in a ducted airway and adapted for air cooling, a third system coil positioned in said ducted airway in spaced relation downstream of said second coil in the direction of air movement through said ducted airway, reversing valve means having a first position for sequentially connecting said first and second coils between said compressor discharge and suction sides for operating said second coil in an air cooling mode and including means for normally by-passing said third coil during the cooling mode of said second coil, and said reversing valve having a second position for sequentially connecting said third coil and first coil between said compressor discharge and suction sides for operating said third coil in a heating mode and including means for normally by-passing said second coil during the heating mode of said third coil, and said heating mode coil being substantially larger than said cooling mode coil.

11. The three coil heat pump system according to claim 10, in which said first coil and third coil have substantially the same heat exchange capacity, and both are substantially larger than said second coil.

12. The three coil heat pump system according to claim 10, in which said third coil is vertically disposed in said air and includes bottom piped conduit connections for self-draining to prevent trapping refrigerant therein when the system is operated in a cooling mode.

13. A climatic control system for the seasonal heating and cooling of an enclosed space comprising in combination with a temperature control zone having air moving means for recirculating air from the enclosed space therethrough, and a refrigeration system heat reclaim condenser positioned in the temperature control zone and being selectively operable for air heating purposes; a three coil reverse cycle heat pump having a single outside condenser coil exposed to ambient, a single evaporator coil positioned in the control zone in an upstream air flow relation to said heat reclaim coil for normal air cooling operation, and a single third coil positioned in the control zone in a downstream air flow relation to said heat reclaim coil and being selectively operable for air heating purposes, and means for rendering said evaporator coil non-operative during the reverse cycle heating operation of said third coil.

14. A climatic control system for the seasonal heating and cooling of air circulated through a temperature control airway, comprising a three coil, reverse cycle heat pump having a first coil exposed to ambient, a cooling mode coil and a separate heating mode coil in spaced relation and being sequentially positioned in the direction of air flow through the airway, said first coil being a condenser coil in the cooling mode and an evaporator coil in the heating mode, said cooling mode and heating mode coils being adapted for selective seasonal operation, means for rendering said cooling mode coil non-operational during the reverse cycle heating mode of operation, and said heating mode coil being substantially larger than said cooling mode coil.

15. The climatic control system according to claim 14, in which said first coil and heating mode coil of said heat pump have substantially the same heat exchange capacity, and both are substantially larger than said cooling mode coil.

16. The climatic control system according to claim 14, including means for reverse cycling defrosting of said first coil during periods of heating mode operation whereby said heating mode coil is inoperative and said cooling mode coil is made operational, and including other means made selectively operational during such reverse cycle defrosting to heat the cold air discharged from said cooling mode coil.

17. The climatic control system according to claim 16, in which said other means comprises a heat reclaim condenser coil of another refrigeration system positioned in said temperature control airway downstream of said cooling mode coil.

18. The climatic control system according to claim 14, which includes a heat reclaim condenser coil of another refrigeration system disposed in said temperature control airway intermediate of said cooling mode coil and said heating mode coil and being constructed and sized relative to said heating mode coil to provide progressive heating of air flowing through said temperature control airway during seasonal winter heating operations.

* * * * *